US009236238B2

(12) United States Patent
Espiau et al.

(10) Patent No.: US 9,236,238 B2
(45) **Date of Patent: *Jan. 12, 2016**

(54) ELECTRODELESS LAMPS WITH COAXIAL TYPE RESONATORS/WAVEGUIDES AND GROUNDED COUPLING ELEMENTS

(75) Inventors: Frederick M. Espiau, Topanga, CA (US); Timothy J. Brockett, Oakland, CA (US); Mehran Matloubian, Encino, CA (US)

(73) Assignee: Topanga USA, Inc., Canoga Park, CA (US)

( * ) Notice: Subject to any disclaimer, the term of this patent is extended or adjusted under 35 U.S.C. 154(b) by 619 days.

This patent is subject to a terminal disclaimer.

(21) Appl. No.: 13/244,037

(22) Filed: Sep. 23, 2011
(Under 37 CFR 1.47)

(65) Prior Publication Data

US 2012/0242223 A1 Sep. 27, 2012

Related U.S. Application Data

(60) Provisional application No. 61/391,036, filed on Oct. 7, 2010.

(51) Int. Cl.
*H05B 37/00* (2006.01)
*H01J 65/04* (2006.01)

(52) U.S. Cl.
CPC ..... *H01J 65/042* (2013.01)

(58) Field of Classification Search
USPC ..... 315/39, 39.51, 248; 313/161, 231.31, 313/231.61
See application file for complete search history.

(56) References Cited

U.S. PATENT DOCUMENTS

| | | | | |
|---|---|---|---|---|
| 6,476,557 | B1 | 11/2002 | Leng et al. | |
| 6,737,809 | B2 | 5/2004 | Espiau et al. | |
| 7,348,732 | B2 * | 3/2008 | Espiau et al. | 315/39 |
| 7,719,195 | B2 * | 5/2010 | DeVincentis et al. | 315/39 |
| 8,319,439 | B2 * | 11/2012 | Hollingsworth et al. | 315/149 |

* cited by examiner

*Primary Examiner* — Tung X Le
(74) *Attorney, Agent, or Firm* — Kilpatrick Townsend & Stockton LLP

(57) ABSTRACT

The present invention is directed to devices and methods for generating light with plasma lamps. More particularly, the present invention provides plasma lamps driven by a radio-frequency source without the use of electrodes inside the bulb and related methods. In a specific embodiment, a coaxial type coupling module is used to drive an electrodeless bulb. Merely by way of example, such plasma lamps can be applied to applications such as stadiums, security, parking lots, military and defense, street lighting, large and small buildings, vehicle headlamps, aircraft landing, bridges, warehouses, UV water treatment, agriculture, architectural lighting, stage lighting, medical illumination, microscopes, projectors and displays, any combination of these, and the like.

104 Claims, 13 Drawing Sheets

ELECTRODELESS LAMPS WITH COAXIAL TYPE RESONATORS/WAVEGUIDES AND GROUNDED COUPLING ELEMENTS

CROSS-REFERENCES TO RELATED APPLICATIONS

This application claims priority from U.S. Provisional Patent Application No. 61/391,036, filed Oct. 7, 2010, entitled "ELECTRODELESS LAMPS WITH COAXIAL TYPE RESONATORS/WAVEGUIDES AND GROUNDED COUPLING ELEMENTS," the disclosure of which is hereby incorporated by reference in its entirety for all purposes.

BACKGROUND OF THE INVENTION

The present invention is directed to devices and methods for generating light with plasma lamps. More particularly, the present invention provides plasma lamps driven by a radio-frequency source without the use of electrodes inside the bulb and related methods. In a specific embodiment, a coaxial type coupling module is used to drive an electrodeless bulb. Merely by way of example, such plasma lamps can be applied to applications such as stadiums, security, parking lots, military and defense, street lighting, large and small buildings, vehicle headlamps, aircraft landing, bridges, warehouses, UV water treatment, agriculture, architectural lighting, stage lighting, medical illumination, microscopes, projectors and displays, any combination of these, and the like.

Plasma lamps provide extremely bright, broadband light, and are useful in applications such as general illumination, projection systems, and industrial processing. The typical plasma lamp manufactured today contains a mixture of gas and trace substances that is excited to form a plasma using a high current passed through closely-contacting electrodes. This arrangement, however, suffers from deterioration of the electrodes inside the bulb, and therefore a limited lifetime. Other limitations also exist with conventional plasma lamps.

From the above, it is seen that techniques for improving plasma lamps are highly desirable.

BRIEF SUMMARY OF THE INVENTION

According to the present invention, techniques directed to devices and methods for generating light with plasma lamps are provided. More particularly, the present invention provides plasma lamps driven by a radio-frequency source without the use of electrodes inside the gas filled vessel (bulb) and related methods. As an example, the radio-frequency source is coupled to the gas filled vessel using a coaxial type resonator/waveguide. In one or more embodiments, the resonator/waveguide is not made using or is generally free from a dielectric material such as alumina or quartz.

In a preferred embodiment, the coupling element that couples RF energy to the coaxial type resonator/waveguide is grounded at one end of the coupling element. In addition the arc of the gas filled vessel (bulb) is substantially not surrounded by the body of the resonator/waveguide allowing the use of reflectors and other optical components used in designing luminaries. That is, the gas filled vessel is substantially includes the arc, which is substantially free from any mechanical blockage by one or more portions of the body of the coaxial type resonator/waveguide, which allows the use of such reflectors and other optical components. Merely by way of example, such plasma lamps can be applied to applications such as stadiums, security, parking lots, military and defense, street lighting, large and small buildings, bridges, warehouses, agriculture, UV water treatment, architectural lighting, stage lighting, medical illumination, microscopes, projectors and displays, any combination of these, and the like. Of course, there can be other variations, modifications, and alternatives.

In a specific embodiment, the present invention provides a plasma electrodeless lamp. The lamp comprises a coaxial type resonator/waveguide body receiving the gas-filled vessel (bulb) at one end of the coaxial type resonator/waveguide by the center conductor. The other end of the center conductor of the coaxial resonator/waveguide is conductively connected to ground (or "shield" of the coaxial waveguide/resonator). An input coupling element couples RF energy to the center conductor of the coaxial waveguide/resonator through a section of the coaxial resonator/waveguide with the ground conductor (shield) removed. One end of the input coupling element is connected to an RF source while the other end is conductively connected to ground. Electromagnetic energy is RF-coupled between the input coupling element and the center conductor of the coaxial type waveguide/resonator. Electromagnetic energy is capacitively, or inductively or a combination of inductively and capacitively coupled to the bulb through the center conductor of the coaxial type waveguide/resonator. The lamp may further comprise a reflector to direct the luminous output of the bulb in the bulb-coupling element assembly. Alternatively, the lamp is free from any reflector design or the like. The lamp further may comprise a ground strap to conductively connect to or be coupled to the top of the bulb and to the conductive lamp body. Alternatively, the ground strap may conductively connect or be coupled to the top of the bulb-coupling element assembly to the reflector, which in turn is conductively connected to the lamp body.

In a specific embodiment, the present invention provides an alternative electrodeless plasma lamp. The lamp includes a gas filled vessel having a transparent or translucent body configured by an inner region and an outer surface region with a cavity being defined within the inner region. The gas filled vessel typically contains an inert gas such as Argon or Xenon (or combination of inert gases) and one or more light emitters such as Mercury, Indium Bromide, Sulfur, Cesium Bromide, among others. The gas filled vessel is closely received by the center conductor of a coaxial type resonator/waveguide. The other end of the center conductor of the coaxial type resonator/waveguide is conductively connected to the ground/shield of the coaxial resonator/waveguide. The center conductor of the coaxial type waveguide/resonator can be surrounded by air or a dielectric material. A portion of the shield (ground) of the coaxial waveguide/resonator is removed. An input coupling element couples RF energy to the center conductor of the coaxial resonator/waveguide through this opening in the shield/ground. One end of the input coupling element is connected to an RF source including an oscillator and an amplifier. The other end of the input coupling element is connected electrically to or is coupled to the shield/ground of the coaxial resonator/waveguide. The center conductor of the coaxial waveguide/resonator couples the RF energy to the gas filled vessel capacitively, inductively, or a combination of capacitively and inductively. The dimensions of the input coupling element and the center conductor of the coaxial resonator/waveguide and the separation between them can be adjusted to optimize RF energy transfer between the RF source and the gas filled vessel (bulb). RF energy ionizes the gas inside the bulb and vaporizes the light emitter(s) resulting in electromagnetic radiation from the bulb in the visible and/or ultra violet and/or infrared part of the spectrum.

In one or more embodiments, the resonant frequency of the coaxial type resonator/waveguide depends on other parameters, alone or in combination. Such parameters may include the length of the center conductor of the coaxial waveguide/resonator or the inductance of the center conductor, the diameter of the center conductor, the separation between the center conductor along its length and the ground (shielding) walls of resonator/waveguide as well as the dielectric constant of material between them resulting in changing the capacitance of the resonator, alone or in combination, among others. By increasing the effective capacitance and inductance of the coaxial type resonator/waveguide the dimensions of the resonator or the resonant frequency of the resonator can be changed.

In preferred embodiments, the plasma lamp apparatus comprises a spatial gap disposed between an input RF coupling element and the center conductor of the coaxial type resonator/waveguide, which is coupled to a gas filled vessel.

A device is also provided in one or more embodiments. The device comprises an RF source; an electromagnetic resonator structure coupled to at least one RF coupling element configured to introduce RF energy into the electromagnetic resonator structure and a bulb comprising a fill material. The bulb is coupled to the electromagnetic resonator structure to emit electromagnetic energy from a spectrum of at least ultraviolet, visible, or infrared; and an exposed region of the bulb protruding outside of the electromagnetic resonator structure to cause a substantial portion of the electromagnetic radiation to be emitted from exterior surfaces of the bulb without reflection from the electromagnetic resonator structure. In one or more embodiments, the spectrum may include combinations of the above as well as other regions. Of course, there can be various combinations, alternatives, and variations.

According to an embodiment, the present invention provides a plasma lamp apparatus having a co-axial configuration. The apparatus includes a radio frequency coupling element having a first portion and a second portion, a length is defined between the first portion and the second portion. The apparatus includes a bulb comprising a fill material coupled to the first portion. The apparatus includes a radio frequency source coupled to the second portion of the radio frequency coupling element. The apparatus includes a housing structure configured from the first portion to the second portion to enclose the length of the radio frequency coupling element. The apparatus includes a reference potential coupled to the housing structure.

According to another embodiment, the present invention provides a plasma lamp apparatus having a co-axial configuration. The apparatus includes a gas filled vessel having a transparent or translucent body configured by an inner region and an outer surface region, a cavity being defined within the inner region. The apparatus includes a first cylindrical member having a first end and a second end, the first end being coupled to the gas filled vessel. The apparatus includes a second cylindrical member having third end and a fourth end, the third end being coupled to second end. The apparatus includes an RF source electrically coupled to the second cylindrical member near the third end. The apparatus includes a resonator body enclosing the first and second cylindrical member, the resonator body being adapted to providing shielding for the first and second cylindrical members. The apparatus includes a reference voltage electrically coupled to the second cylindrical member near the fourth end.

According to yet another embodiment, the present invention provides a plasma lamp apparatus. The apparatus includes a vessel being filled with a filling material, the vessel being free from electrode. The apparatus includes a center conductive member having a first end and a second end, the center conductive member being characterized by a substantially cylindrical shape centered on a first axis, the first end being coupled to the vessel. The apparatus includes an outer conductive member, the outer conductive member being characterized by a substantially cylindrical shape centered on the first axis, the outer conductive member having an inner volume, the center conductive member being positioned inside the inner volume, the outer conductive member being associated with one or more resonance frequencies. The apparatus includes a first ground potential, the first ground potential being electrically coupled to the second end of the center conductive member.

According to yet another embodiment, the present invention provides a plasma lamp apparatus. The apparatus includes a vessel being filled with a filling material, the vessel being free from electrode. The apparatus includes a center conductive member having a first end and a second end, the center conductive member being characterized by a substantially cylindrical shape centered on a first axis, the first end being coupled to the vessel. The apparatus includes an outer conductive member, the outer conductive member being characterized by a substantially cylindrical shape centered on the first axis, the outer conductive member having an inner volume, the center conductive member being positioned inside the inner volume, the outer conductive member being associated with one or more resonance frequencies. The apparatus includes a first ground potential, the first ground potential being electrically coupled to the second end of the center conductive member.

According to yet another embodiment, the present invention provides a plasma lamp apparatus. The apparatus includes a vessel being filled with a filling material, the vessel being free from electrode. The apparatus includes a center conductive member having a first end and a second end, the center conductive member being characterized by a substantially cylindrical shape centered on a first axis, the first end being coupled to the vessel. The apparatus includes an outer conductive member, the outer conductive member being characterized by a substantially cylindrical shape centered on the first axis, the outer conductive member having an inner volume, the center conductive member being positioned inside the inner volume, the outer conductive member being associated with one or more resonance frequencies. The apparatus includes an input coupling module, the input coupling module comprising a housing and an input coupling element, the housing and the input coupling element being characterized by a substantially cylindrical shape, the input coupling module and the housing sharing a second axis.

According to yet another embodiment, the present invention provides a plasma lamp apparatus. The apparatus includes a vessel being filled with a filling material, the vessel being free from electrode. The apparatus includes a center conductive member having a first end and a second end, the center conductive member being characterized by a substantially cylindrical shape centered on a first axis, the first end being coupled to the vessel. The apparatus includes an outer conductive member having a first portion and a second portion, the first portion being characterized by a substantially cylindrical shape centered on the first axis and a first diameter, the second portion being characterized by the cylindrical shape centered on the first axis and a second diameter, the second diameter being greater than the first diameter, the outer conductive member having an inner volume positioned within the first and second portions of the outer conductive member, the center conductive member being positioned inside the inner volume. The apparatus includes a first ground potential, the first ground potential being electrically coupled to the second end of the center conductive member.

According to yet another embodiment, the present invention provides a plasma lamp apparatus. The apparatus includes a vessel being filled with a filling material, the vessel being free from electrode. The apparatus includes a center conductive member having a first end and a second end, the center conductive member being characterized by a substantially cylindrical shape centered on a first axis, the first end being coupled to the vessel. The apparatus includes an outer conductive member having a first portion and a second portion, the first portion being characterized by a substantially cylindrical shape centered on the first axis and a first diameter, the second portion being characterized by a substantially rectangular shape, the outer conductive member having an inner volume positioned within the first and second portions of the outer conductive member, the center conductive member being positioned inside the inner volume. The apparatus includes a first ground potential, the first ground potential being electrically coupled to the second end of the center conductive member.

According to yet another embodiment, the present invention provides a plasma lamp apparatus. The apparatus includes a vessel being filled with a filling material, the vessel being free from electrode. The apparatus includes a center conductive member having a first end and a second end, the center conductive member being characterized by a substantially cylindrical shape centered on a first axis, the first end being coupled to the vessel. The apparatus includes an outer conductive member having a first portion and a second portion, the first portion being characterized by a substantially cylindrical shape centered on the first axis and a first diameter, the second portion being characterized by a substantially semi-spherical shape, the outer conductive member having an inner volume positioned within the first and second portions of the outer conductive member, the center conductive member being positioned inside the inner volume. The apparatus includes a first ground potential, the first ground potential being electrically coupled to the second end of the center conductive member.

According to yet another embodiment, the present invention provides a plasma lamp apparatus. The apparatus includes a vessel being filled with a filling material, the vessel being free from electrode. The apparatus includes a center conductive member having a first end and a second end, the center conductive member being characterized by a substantially cylindrical shape centered on a first axis, the first end being coupled to the vessel. The apparatus includes an outer conductive member, the outer conductive member being characterized by a substantially cylindrical shape centered on the first axis and a first diameter, the outer conductive member having an inner volume positioned within the outer conductive member, the inner volume having a first portion and a second portion, the inner volume being substantially cylindrical, the center conductive member being positioned inside the first portion of the inner volume. The apparatus includes a first capacitor being positioned with in the second portion of the inner volume, the first capacitor being electrically coupled to the second end of the center conductive member. The apparatus includes a first ground potential, the first ground potential being electrically coupled to the first capacitor.

According to yet another embodiment, the present invention provides a plasma lamp apparatus. The apparatus includes a vessel being filled with a filling material, the vessel being free from electrode. The apparatus includes a center conductive member having a first end and a second end, the center conductive member being characterized by a substantially cylindrical shape centered on a first axis, the first end being coupled to the vessel. The apparatus includes an outer conductive member, the outer conductive member being characterized by a substantially cylindrical shape centered on the first axis and a first diameter, the outer conductive member having an inner volume positioned within the outer conductive member, the inner volume having a first portion and a second portion, the inner volume being substantially cylindrical, the center conductive member being positioned inside the first portion of the inner volume. The apparatus includes an input coupling element including a spiral inductor positioned between the center conductive member and the outer conductive member, the spiral inductor being wrapped around a portion of the center conductive member. The apparatus includes a first ground potential, the first ground potential being electrically coupled to the second end of the center conductive end.

According to yet another embodiment, the present invention provides a plasma lamp apparatus. The apparatus includes a vessel being filled with a filling material, the vessel being free from electrode. The apparatus includes a center conductive member having a first end and a second end, the center conductive member being characterized by a substantially cylindrical shape centered on a first axis, the first end being coupled to the vessel, the center conductive member being characterized by a first length. The apparatus includes an outer conductive member, the outer conductive member being characterized by a substantially cylindrical shape centered on the first axis and a first diameter, the outer conductive member having an inner volume positioned within the outer conductive member, the inner volume having a first portion and a second portion, the inner volume being substantially cylindrical, the inner volume including first portion and a second portion, the center conductive member being positioned inside the first portion of the inner volume. The apparatus includes an input coupling element including a spiral inductor positioned within the second portion of the inner volume, the spiral inductor having an inner portion, the inner portion being free from a solid portion of the center conductive member. The apparatus includes a first ground potential, the first ground potential being electrically coupled to the second end of the center conductive end.

According to yet another embodiment, the present invention provides a plasma lamp apparatus. The apparatus includes a vessel being filled with a filling material, the vessel being free from electrode. The apparatus includes an output coupling member having a first end and a second end, the output coupling member being characterized by a substantially cylindrical shape centered on a first axis, the first end being substantially solid and coupled to the vessel, the second end comprising a first spiral conductor. The apparatus includes an outer conductive member, the outer conductive member being characterized by a substantially cylindrical shape centered on the first axis and a first diameter, the outer conductive member having an inner volume positioned within the outer conductive member, the inner volume having a first portion and a second portion, the inner volume being substantially cylindrical, the output coupling member being positioned inside the of the inner volume. The apparatus includes an input coupling member, the input coupling member including and housing a second spiral inductor positioned within the housing. The apparatus includes a first ground potential, the first ground potential being electrically coupled to the second end of the center conductive end.

According to yet another embodiment, the present invention provides a plasma lamp apparatus. The apparatus includes a vessel being filled with a filling material, the vessel being free from electrode. The apparatus includes an output coupling member having a first end and a second end, the output coupling member being characterized by a substantially cylindrical shape centered on a first axis, the first end being substantially solid and coupled to the vessel, the second end comprising a first spiral conductor. The apparatus includes an outer conductive member, the outer conductive member being characterized by a substantially cylindrical shape centered on the first axis and a first diameter, the outer conductive member having an inner volume positioned within the outer conductive member, the inner volume having a first portion and a second portion, the inner volume being substantially cylindrical, the output coupling member being positioned inside the of the inner volume. The apparatus includes an input coupling member, the input coupling member including and a housing and a second spiral inductor positioned within the housing. The apparatus includes a first capacitor positioned inside the inner volume and electrically coupled to the first spiral conductor. The apparatus includes a first ground potential, the first ground potential being electrically coupled to the first capacitor.

According to yet another embodiment, the present invention provides a plasma lamp apparatus. The apparatus includes a vessel being filled with a filling material, the vessel being free from electrode, the vessel having a top side and a bottom side. The apparatus includes a first output coupling member having a first end and a second end, the first output coupling member being characterized by a substantially cylindrical shape centered on a first axis, the first end being substantially solid and coupled to the bottom side of the vessel, the second end comprising a first spiral conductor. The apparatus includes a second coupling member coupled to the top side of the vessel. The apparatus includes an outer conductive member, the outer conductive member being characterized by a substantially cylindrical shape centered on the first axis and a first diameter, the outer conductive member having an inner volume positioned within the outer conductive member, the inner volume having a first portion and a second portion, the inner volume being substantially cylindrical, the first output coupling member being positioned inside the of the inner volume. The apparatus includes an input coupling member, the input coupling member including and a housing and a second spiral inductor positioned within the housing. The apparatus includes a first capacitor positioned inside the inner volume and electrically coupled to the first spiral conductor. The apparatus includes a first ground potential, the first ground potential being electrically coupled to the first capacitor.

According to yet another embodiment, the present invention provides a plasma lamp apparatus. The apparatus includes a vessel being filled with a filling material, the vessel being free from electrode. The apparatus includes a center conductive member having a first end and a second end, the center conductive member being characterized by a substantially cylindrical shape centered on a first axis, the first end being coupled to the vessel. The apparatus includes an outer conductive member, the outer conductive member being characterized by a substantially cylindrical shape centered on the first axis, the outer conductive member having an inner volume, the center conductive member being positioned inside the inner volume, the outer conductive member being associated with one or more resonance frequencies. The apparatus includes a conductive ring electrically coupled to the vessel. The apparatus includes a grounding strap electrically coupled to the vessel and the conductive ring and the outer conductive member. The apparatus includes a first ground potential, the first ground potential being electrically coupled to the second end of the center conductive member.

According to yet another embodiment, the present invention provides a plasma lamp apparatus. The apparatus includes a vessel being filled with a filling material, the vessel being free from electrode, the vessel having a top side and a bottom side. The apparatus includes a conductive member having a first end and a second end, the center conductive member being characterized by a substantially cylindrical shape centered on a first axis, the first end being coupled to the vessel. The apparatus includes a top coupling member coupled to the top side of the vessel. The apparatus includes an outer conductive member, the outer conductive member being characterized by a substantially cylindrical shape centered on the first axis, the outer conductive member having an inner volume, the center conductive member being positioned inside the inner volume, the outer conductive member being associated with one or more resonance frequencies; a first ground potential, the first ground potential being electrically coupled to the second end of the center conductive member.

One or more benefits may be achieved using the present lamp and related methods. As an example, the present lamp is compact and can be configured inside conventional luminaries, such as luminaries used for street lighting and parking lot lighting. Furthermore, the present lamp can be configured to have an exposed arc to allow use of conventional optical components, such as aluminum reflectors. In one or more embodiments, the present lamp can also be manufactured more efficiently and at lower costs than the conventional dielectric resonators, such as those described in U.S. Pat. No. 6,737,809B2. Furthermore, the lamp can be configured to have an exposed arc to allow use of conventional optical components. These and other benefits may be achieved in one or more embodiments. Further details of the present invention can be found throughout the present specification and more particularly below.

The present invention achieves these benefits and others in the context of known process technology. However, a further understanding of the nature and advantages of the present invention may be realized by reference to the attached drawings.

BRIEF DESCRIPTION OF THE DRAWINGS

A more complete understanding of the present invention and its advantages will be gained from a consideration of the following description of preferred embodiments, read in conjunction with the accompanying drawings provided herein. In the figures and description, numerals indicate various features of the invention, and like numerals referring to like features throughout both the drawings and the description.

DETAILED DESCRIPTION OF THE INVENTION

Figure 1:
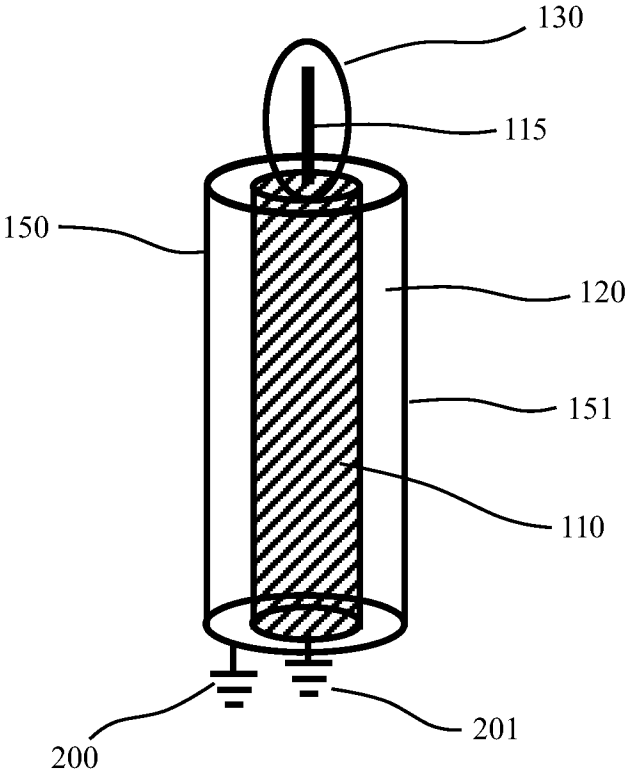
FIG. 1 is simplified drawing of the coaxial type resonator/waveguide with one end of the center conductor connected to the gas filled vessel and the other end is connected to the ground/shield of the coaxial resonator/waveguide.

The present invention is directed to devices and methods for generating light with plasma lamps. More particularly, the present invention provides plasma lamps driven by a radio-frequency source without the use of electrodes inside the bulb and related methods. In a specific embodiment, a coaxial type coupling module is used to drive an electrodeless bulb. Merely by way of example, such plasma lamps can be applied to applications such as stadiums, security, parking lots, military and defense, street lighting, large and small buildings, vehicle headlamps, aircraft landing, bridges, warehouses, UV water treatment, agriculture, architectural lighting, stage lighting, medical illumination, microscopes, projectors and displays, any combination of these, and the like.

The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the Claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object. Additionally, the terms "first" and "second" or other like descriptors do not necessarily imply an order, but should be interpreted using ordinary meaning.

As background for the reader, we would like to describe conventional lamps and their limitations that we discovered. Electrodeless plasma lamps driven by microwave sources have been proposed. Conventional configurations include a gas filled vessel (bulb) containing Argon and a light emitter such as Sulfur or Cesium Bromide (see for example, U.S. Pat. No. 6,476,557B1). The bulb is positioned inside an air resonator/waveguide with the microwave energy provided by a source such as a magnetron and introduced into the resonator/waveguide to heat and ionize the Argon gas and vaporize the Sulfur to emit light. To use RF sources that are efficient and low-cost it is desirable to design the resonator/waveguide to operate at frequencies below approximately 2.5 GHz and preferably below 1 GHz. A conventional air resonator/waveguide operating in the fundamental resonant mode of the resonator at 1 GHz has at least one dimension that is approximately 15 cm long since this length is about half the free-space wavelength (lambda/2) of the resonant frequency of the resonator.

This results in limitations that were discovered. Such limitations include a resonator/waveguide size that is too large for most commercial lighting applications since the resonator/waveguide will not fit within typical lighting fixtures (luminaries). In addition since the bulb was placed inside the air/resonator cavity, the arc of the bulb is not accessible for use in the design of reflectors for various types of luminaries used in commercial and industrial lighting applications.

In the configuration proposed in U.S. Pat. No. 6,737,809B2, Espiau, et al., the air inside the resonator is replaced with alumina resulting in reducing the size of the resonator/waveguide since the free-space wavelength (fundamental mode guided wavelength for this resonator/waveguide) is now reduced approximately by the square-root of the effective dielectric constant of the resonator body. This approach has some advantages over the air resonator in U.S. Pat. No. 6,476,557B1 by reducing the size of the resonator but it has its own drawbacks. Such drawbacks may include higher manufacturing costs, losses associated with the dielectric material, and blockage of light from the bulb by the dielectric material. In this approach, the arc of the bulb is not accessible either limiting its use in various types of luminaries used in commercial and industrial lighting applications.

FIG. 1 is simplified drawing of the coaxial type resonator/waveguide according to an embodiment of the present invention. This diagram is merely an example, which should not unduly limit the scope of the claims. One of ordinary skill in the art would recognize many variations, alternatives, and modifications. As shown in FIG. 1, one end of the center conductor 110 of the coaxial resonator/waveguide is connected to a gas filled vessel 130 containing the arc 115 that is substantially not surrounded by the resonator/waveguide. Among other things, the waveguide is specifically configured to deliver energy to the gas filled vessel 130. For example, the gas filled vessel 130 (e.g., an electrodeless bulb) is adapted to emit bright light when the waveguide in FIG. 1 delivers electrical energy to the gas filled vessel 130.

The other end of the center conductor 115 is connected to ground 201 or the outside (shield) conductor 150 and 151 of the coaxial resonator/waveguide which are also connected to ground potential 200. As shown in FIG. 1, the center conductor shares its axis with the coaxial resonator. According to one embodiment, the center conductive and the coaxial resonator are insulated from each other. For example, the center conductor of the coaxial resonator/waveguide is surrounded by air 120, which provides a certain degree of electrical insulation. In a specific embodiment, insulating material is provided between the center conductor and the coaxial resonator.

Figure 2:
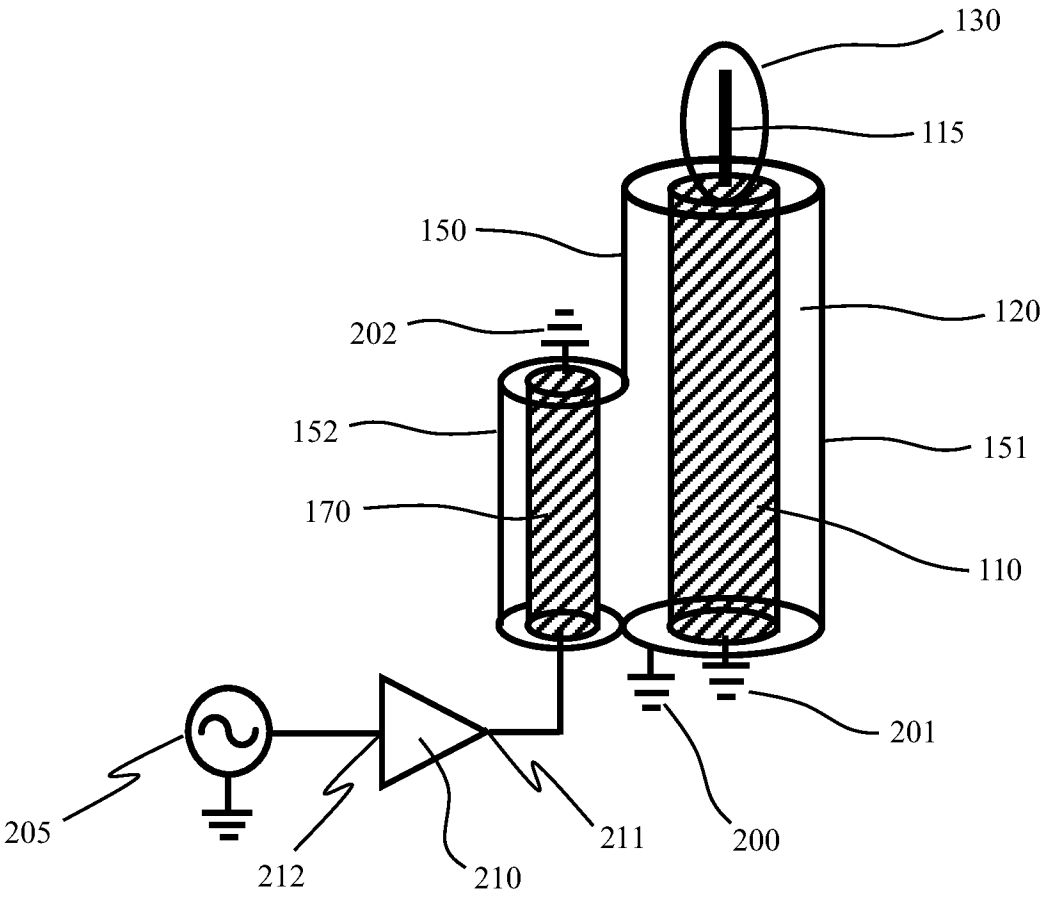
FIG. 2 is a simplified drawing of an embodiment of the present invention of a coaxial type resonator/waveguide showing the input coupling element along with an RF source consisting of an oscillator and an amplifier coupling RF energy to the center conductor of the coaxial waveguide/resonator. One end of the input coupling element is connected to the RF source and the other end is electrically connected to ground/shield.

FIG. 2 is a simplified illustrating an electrodeless lamp with a coaxial type resonator/waveguide have an input coupling element according to an embodiment of the present invention. This diagram is merely an example, which should not unduly limit the scope of the claims. One of ordinary skill in the art would recognize many variations, alternatives, and modifications. An input coupling element 170, along with an RF source, consisting of an oscillator 205 and an amplifier 210 for coupling RF energy to the center conductor 110 of the coaxial resonator/waveguide through an opening in the outside conductor (shield) 150 of the coaxial resonator/waveguide. The oscillator 205 is electrically connected to the input 212 of the amplifier 210 and the output 211 of the amplifier is connected to one end of the input coupling element 170. The other end of the input coupling element is connected to ground 202 or the outside conductor (shield) 152 of the coaxial resonator/waveguide. The RF energy coupled to the center conductor 110 of the coaxial resonator/waveguide is coupled at one end of the center conductor capacitively, inductively, or combination of capacitively and inductively to the gas filled vessel (bulb) 130.

Depending on the application, the filled vessel 130 may include various types of materials. In various embodiments, the filled vessel 130 functions as an electrodeless bulb containing an inert gas such as Argon or Xenon and a light emitter such as Mercury, Sodium, Dysprosium, Sulfur or a metal halide salt such as Indium Bromide, Scandium Bromide, Thallium Iodide, Holmium Bromide, Cesium Iodide or other similar materials (or it can simultaneously contain multiple light emitters).

The vessel 130 includes an arc 115. As shown, the arc 115 inside the bulb is not substantially surrounded by the body of the coaxial resonator/waveguide. The other end of the center conductor of the coaxial resonator/waveguide is connected to ground 201 or the outside conductor (shield) of the coaxial resonator/waveguide 151 which is also connected to ground potential 200. In this case the center conductor is surrounded by air 120.

The resonant frequency of the coaxial resonator/waveguide depends on the dimensions (length, diameter, etc.) of the center conductor as well as the separation between the center conductor and the outside conductor (shield) of the coaxial resonator/waveguide as well as other parameters. The RF impedance match to the gas filled vessel depends on the dimensions of the input coupling element and its separation to the center conductor. In a specific embodiment, the input coupling element and the center conductive are electrically insulated from each other.

It is to be understood that even though the structure of this resonator/waveguide is in the shape of a coaxial resonator/waveguide, the mode of operation of the resonator/waveguide is not necessarily a coaxial mode. For example, there can be other ways for resonator/waveguide to operate.

Figure 3:
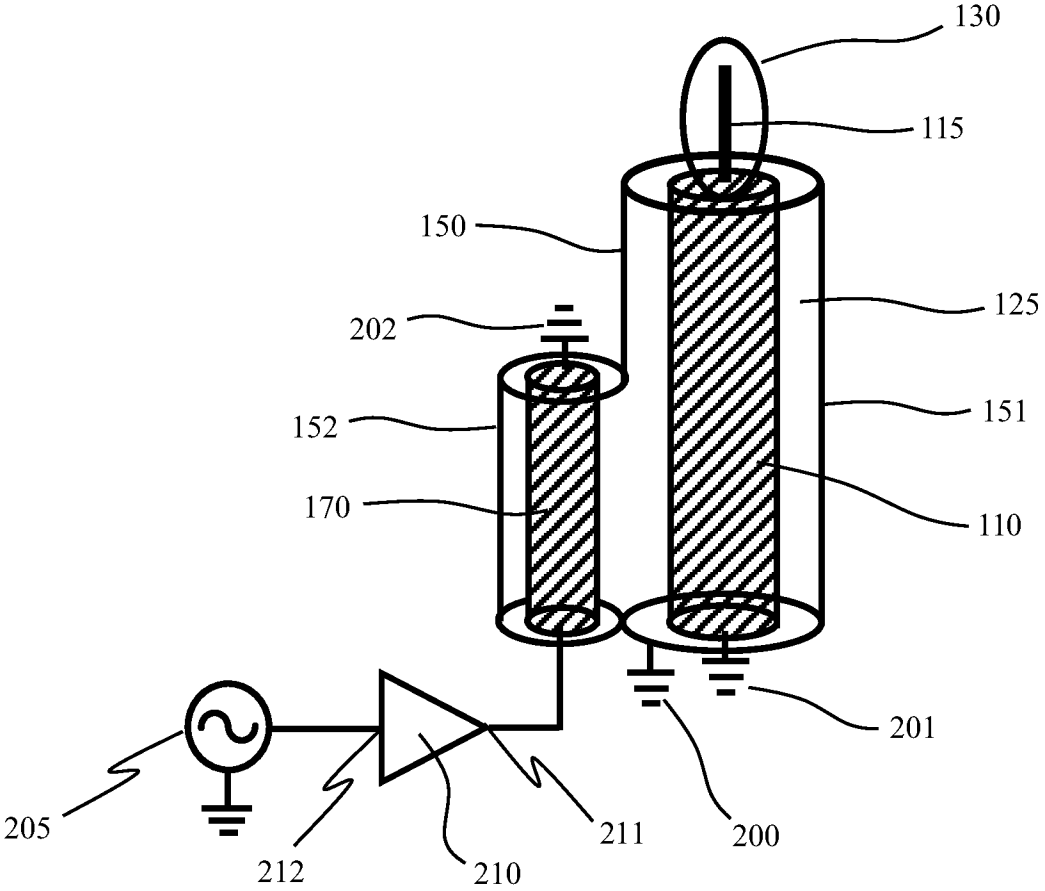
FIG. 3 illustrates another embodiment of the present invention similar to FIG. 2. In this case instead of air surrounding the center conductor of the coaxial waveguide/resonator a dielectric material surrounds the center conductor.

FIG. 3 is simplified diagram illustrating an electrodeless lamp according to an embodiment of the present invention. This diagram is merely an example, which should not unduly limit the scope of the claims. One of ordinary skill in the art would recognize many variations, alternatives, and modifications. As an example, the apparatus shown in FIG. 3 shares certain similarities to the apparatus illustrated in FIG. 2. One of the differences is that instead of air surrounding the center conductor of the coaxial waveguide/resonator 120 as shown in FIG. 2, a dielectric material 125 surrounds the center conductor. The dielectric material can surround both the center conductor 110 and the input coupling element 170 or surround just the center conductor. The dielectric material can be made from alumina, quartz, or other similar materials. In one embodiment, the dielectric material is provided to increase the capacitance between the center conductor and the outside conductor (shield) of the coaxial resonator/waveguide giving another parameter that can be adjusted to change the size and dimensions of the coaxial resonator/waveguide. In one embodiment, the dielectric material is specifically selected and provided to match a specific resonance frequency.

Figure 4:
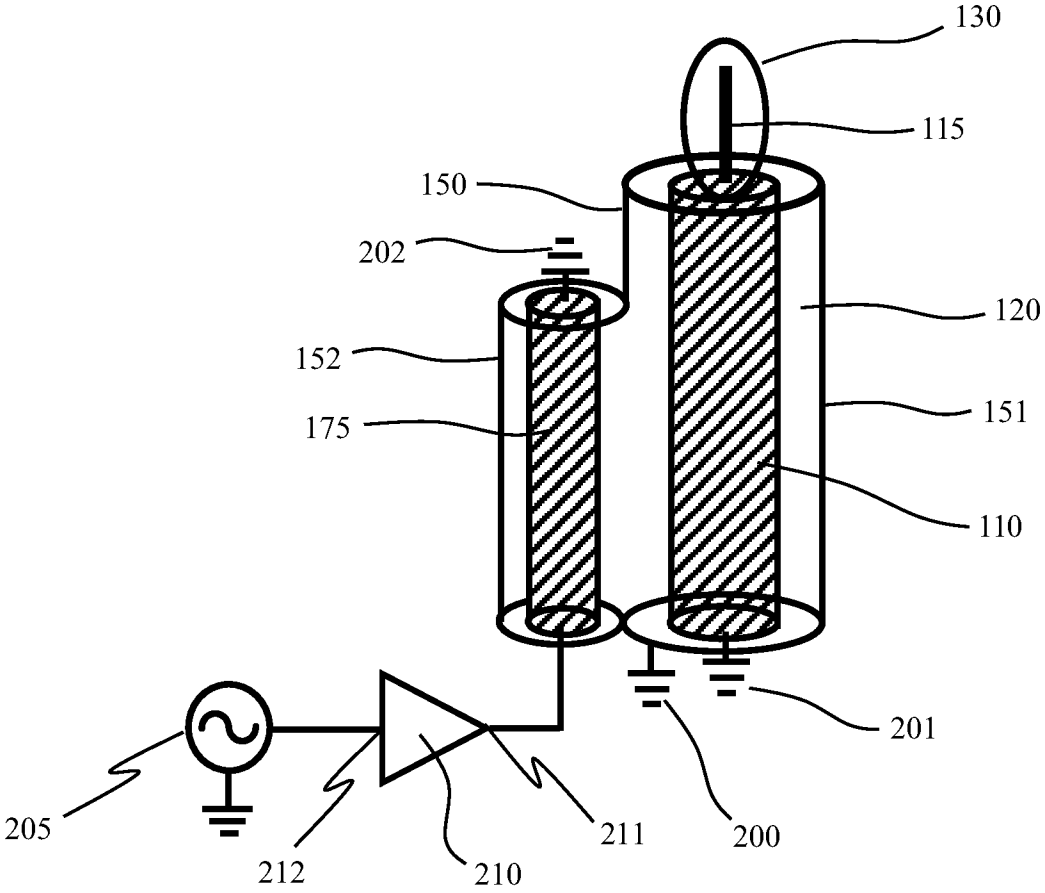
FIG. 4 illustrates the lamp in FIG. 2 with a longer RF input coupling element.

In certain embodiments, coupling characteristics between the input outputting element 175 and the output coupling element 110 are functions of the dimensions of the coupling elements. FIG. 4 is simplified diagram illustrating an electrodeless lamp according to an embodiment of the present invention. This diagram is merely an example, which should not unduly limit the scope of the claims. One of ordinary skill in the art would recognize many variations, alternatives, and modifications. As shown in FIG. 4, the electrodeless lamp illustrated in FIG. 4 is similar to the electrodeless lamp illustrated in FIG. 2. One of the differences is that the electrodeless lamp in FIG. 4 includes an RF input coupling element 175 that is longer than the input element illustrated in FIG. 2. The longer RF input coupling element increases the coupling between the input coupling element and the center conductor of the coaxial resonator/waveguide.

Figure 5A:
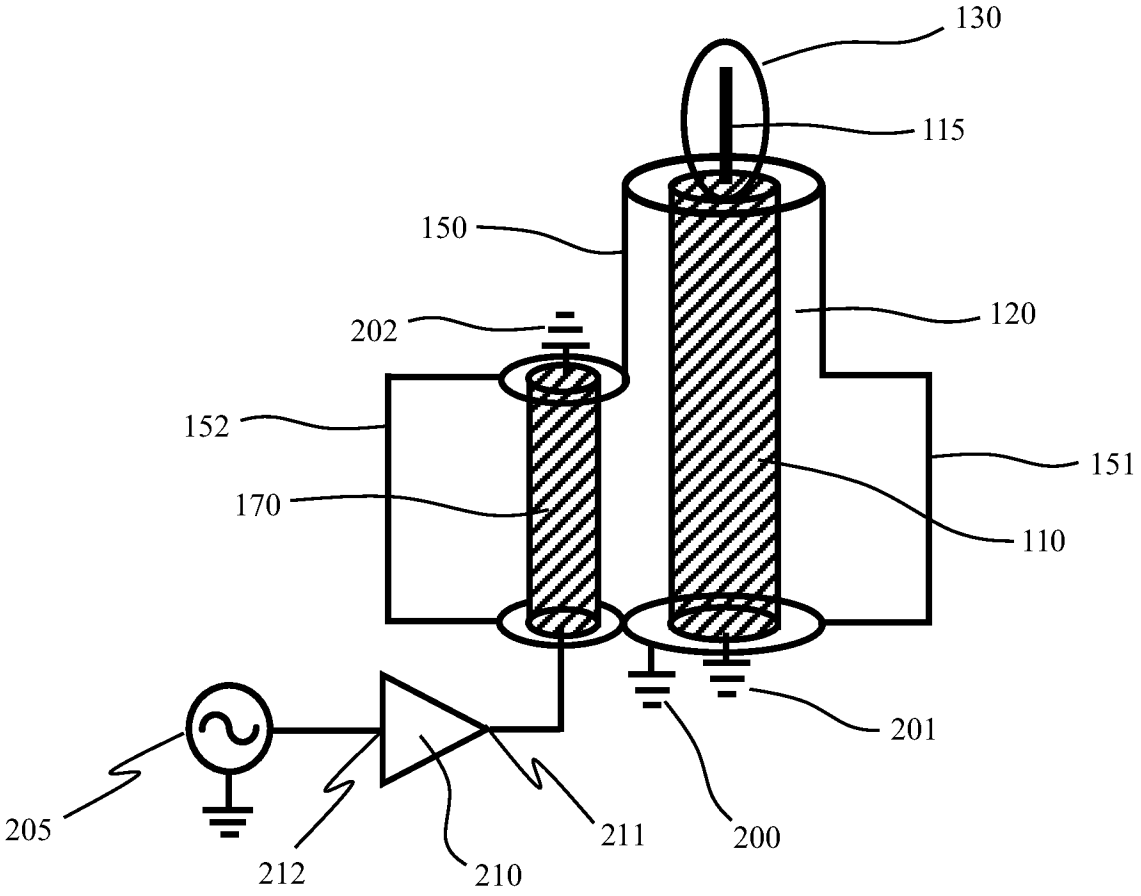
FIG. 5A illustrates another embodiment of the present invention. The coaxial waveguide/resonator is similar to FIG. 2 with the ground/shielding walls of part of the coaxial waveguide/resonator further separated from the center conductor.

In certain embodiments, coupling characteristics and resonance are also functions of waveguide. FIG. 5A is simplified diagram illustrating an electrodeless lamp having alternative waveguide structure according to an embodiment of the present invention. This diagram is merely an example, which should not unduly limit the scope of the claims. One of ordinary skill in the art would recognize many variations, alternatives, and modifications. As shown in FIG. 5A, the electrodeless lamp illustrated in FIG. 5A is similar to the electrodeless lamp illustrated in FIG. 3. The ground/shielding walls 151 and 152 of the electrodeless lamp are different from that illustrated FIG. 3. More specifically, the shielding wall 151 (e.g., which functions as a waveguide) is expanded further away from the center conductor. Similarly, the shielding wall 152 is further away (compared to the configuration shown in FIG. 3) from the RF input coupling element. In this case the expansion of the conducting walls (shielding) of the coaxial resonator/waveguide is in rectangular shape. Among other features, the expansion of the walls can be used to adjust the resonant frequency of the coaxial resonator/waveguide.

Figure 5B:
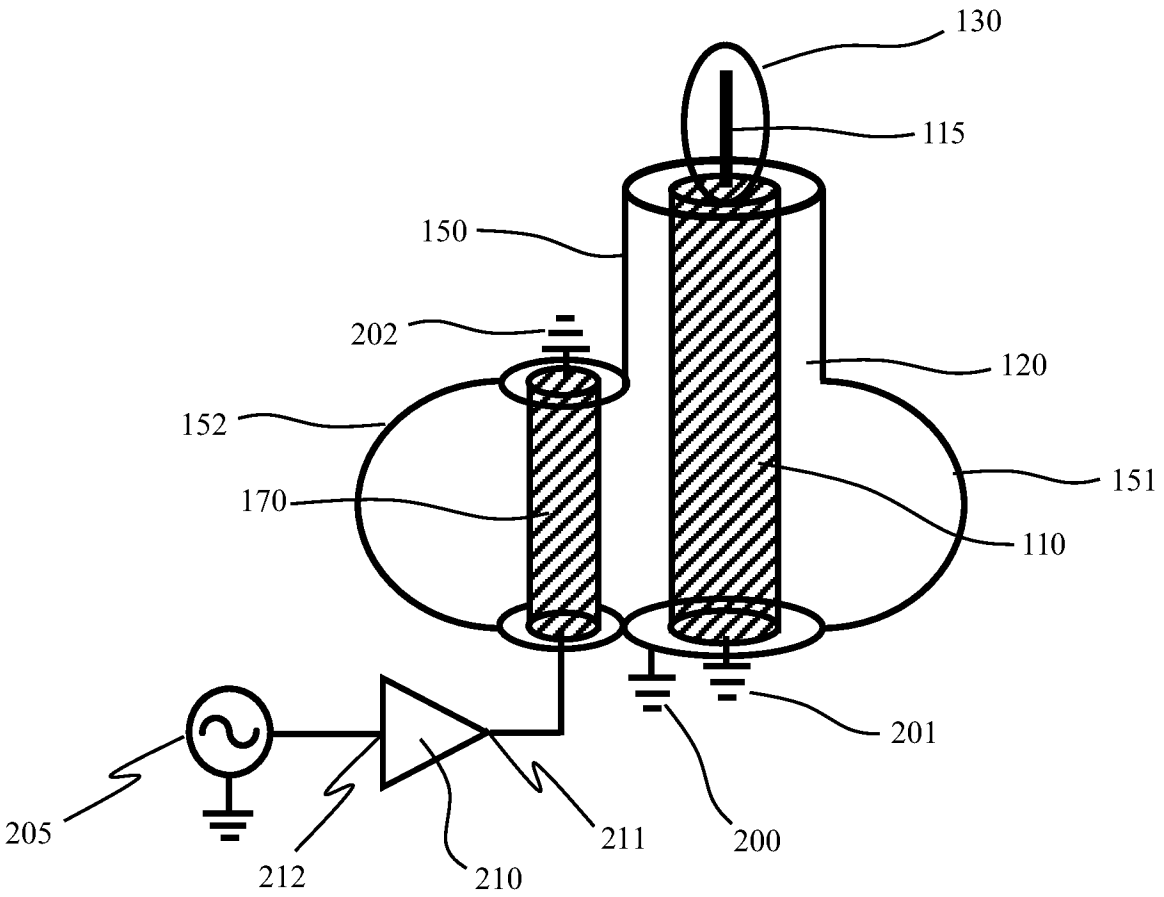
FIG. 5B is similar to FIG. 5A with the ground/shielding walls of part of the coaxial waveguide/resonator in the form of semi-spherical instead of rectangular.

FIG. 5B is simplified diagram illustrating an electrodeless lamp having waveguide structure in semi-spherical shape according to an embodiment of the present invention. This diagram is merely an example, which should not unduly limit the scope of the claims. One of ordinary skill in the art would recognize many variations, alternatives, and modifications. As shown, the electrodeless lamp illustrated in FIG. 5B is similar to the lamp illustrated in FIG. 5A. One of differences is that the ground/shielding walls of part of the coaxial waveguide/resonator 151 and 152 are expanded further away from the center conductor and RF input coupling element. More specifically, the expansion of the conducting walls (shielding) of the coaxial resonator/waveguide is semi-spherical in shape. The expansion of the walls can be used to adjust the resonant frequency of the coaxial resonator/waveguide.

Figure 6:
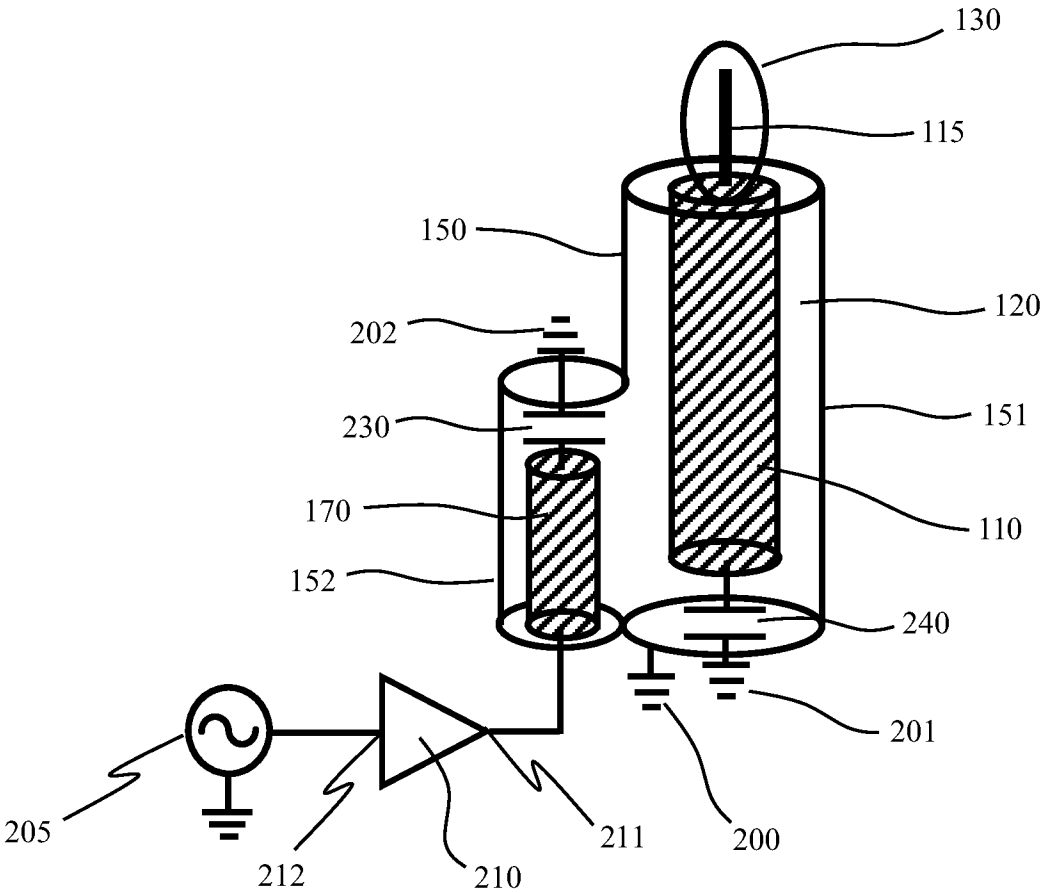
FIG. 6 illustrates another embodiment of the present invention. The coaxial resonator/waveguide is similar to FIG. 2 except that the center conductor and the input coupling element are connected to the ground/shield through a capacitor. The values of the capacitors are selected such that they provide a low impedance path to ground/shield at the resonant frequency of the coaxial type resonator/waveguide.

FIG. 6 illustrates an electrodeless lamp according to an embodiment of the present invention. This diagram is merely an example, which should not unduly limit the scope of the claims. One of ordinary skill in the art would recognize many variations, alternatives, and modifications. As shown, the coaxial resonator/waveguide 151 and 151 in FIG. 6 is similar to that illustrated in FIG. 2. One of the differences is that the center conductor 110 of the coaxial resonator/waveguide is electrically connected to the ground 201 or shield 151 through capacitor 240. In a similar configuration, the input coupling element 170 is connected to the ground 202 or shield 152 through the capacitor 230. In various embodiments, the values of the capacitors are selected such that they provide a low impedance path to ground/shield at the resonant frequency of the coaxial resonator/waveguide.

Figure 7:
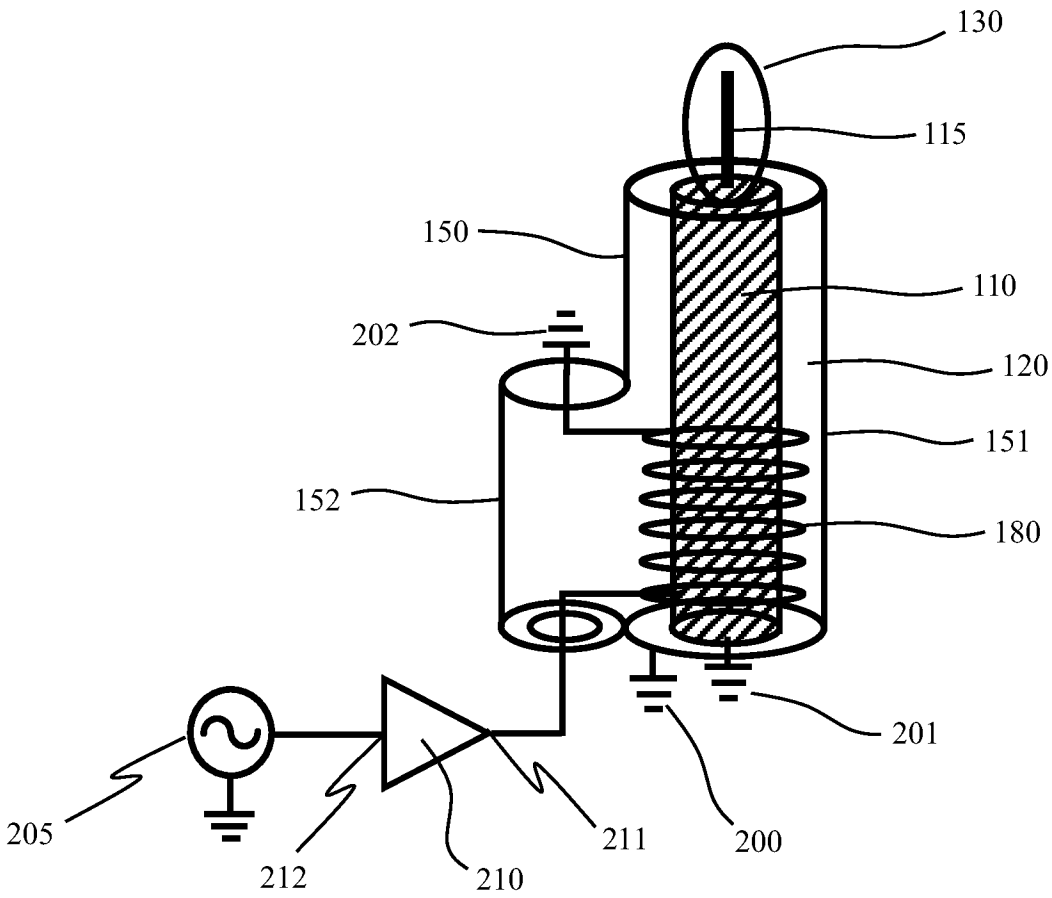
FIG. 7 illustrates another embodiment of the present invention. The input RF coupling element is in the form of a spiral inductor and wraps around the center conductor of the coaxial resonator/waveguide.

FIG. 7 illustrates an electrodeless lamp having a spiral coupling element according to an embodiment of the present invention. This diagram is merely an example, which should not unduly limit the scope of the claims. One of ordinary skill in the art would recognize many variations, alternatives, and modifications. The input RF coupling element 180 in this embodiment is in the form of a spiral inductor and wraps around the center conductor 110 of the coaxial resonator/waveguide. One end of the input coupling element is connected to the output 211 of the RF amplifier 210. The other end of the input coupling element is connected to ground 202 or the shield 150/152 of the coaxial resonator/waveguide. One end of the center conductor 110 (similar to FIG. 2) is coupled to the gas filled vessel 130 and the other end is electrically connected to ground 201. In a specific embodiment, the center conductor is electrically coupled to the shield 151 of the coaxial type resonator/waveguide which is also connected to ground potential 200.

Figure 8:
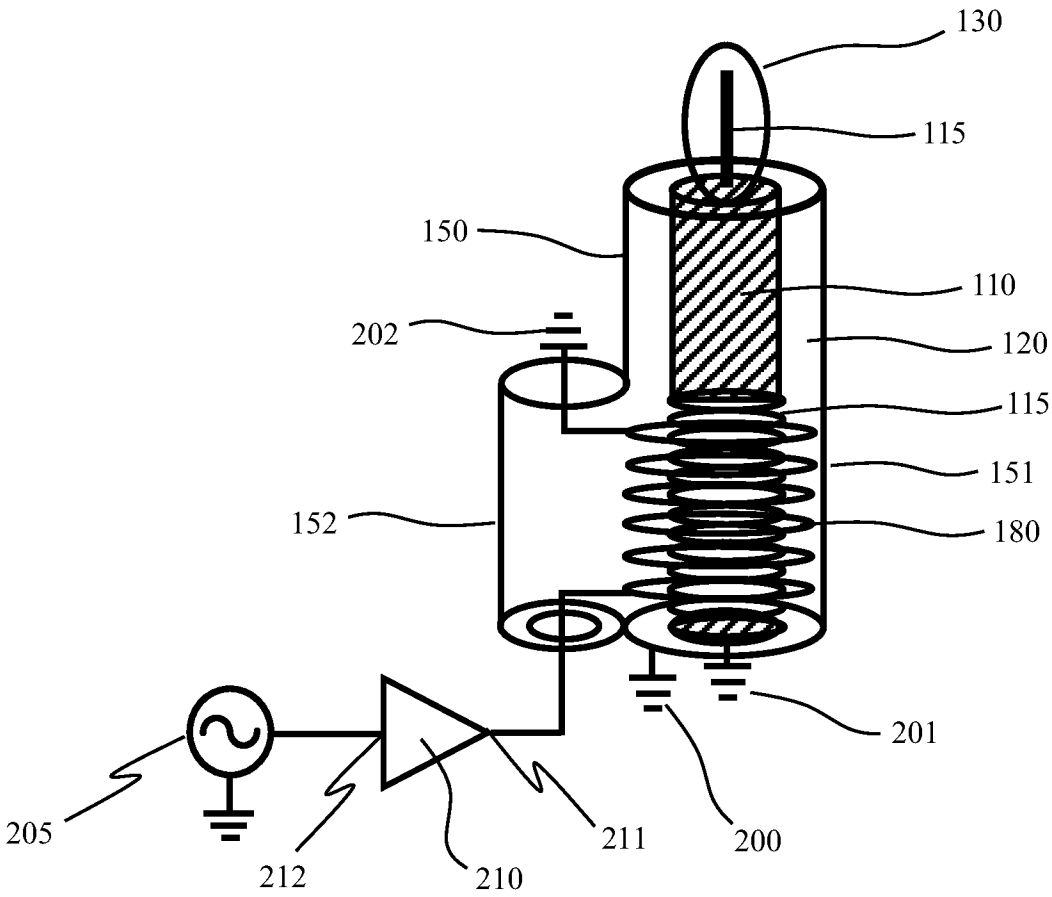
FIG. 8 illustrates another embodiment of the present invention. It is similar to FIG. 7 with part of the center conductor of the coaxial resonator/waveguide replaced by spiral inductor.

FIG. 8 illustrates an electrodeless lamp according to another embodiment of the present invention. This diagram is merely an example, which should not unduly limit the scope of the claims. One of ordinary skill in the art would recognize many variations, alternatives, and modifications. The configuration of the electrodeless lamp in FIG. 8 is similar to the lamp illustrated in FIG. 7. One of the differences is that a portion of the center conductor 110 of the coaxial resonator/waveguide is replaced by a spiral inductor 115. For example, by increasing the inductance of the center conductor of the coaxial resonator/waveguide the resonant frequency of the resonator/waveguide can be decreased. In various embodiments, the length of the center spiral inductor 115 is selected based on a desired resonant frequency. As shown in FIG. 8, one end of the spiral inductor 115 is connected to center conductor 110 while the other end is connected to ground 201 and/or shield 151 of the coaxial type resonator/waveguide which is also connected to ground potential 200. The other end of the center conductor 110 is coupled to the gas filled vessel 130.

The input coupling element is in the form of spiral inductor 180, which is similar to the inductor illustrated in FIG. 7. The spiral inductor 180 wraps around the spiral conductor 115 portion of the center conductor of the coaxial resonator/waveguide. One end of the input coupling element is connected to the output 211 of the RF amplifier 210. The other end of the input coupling element is connected to ground 202 or the shield 150/152 of the coaxial resonator/waveguide.

Figure 9:
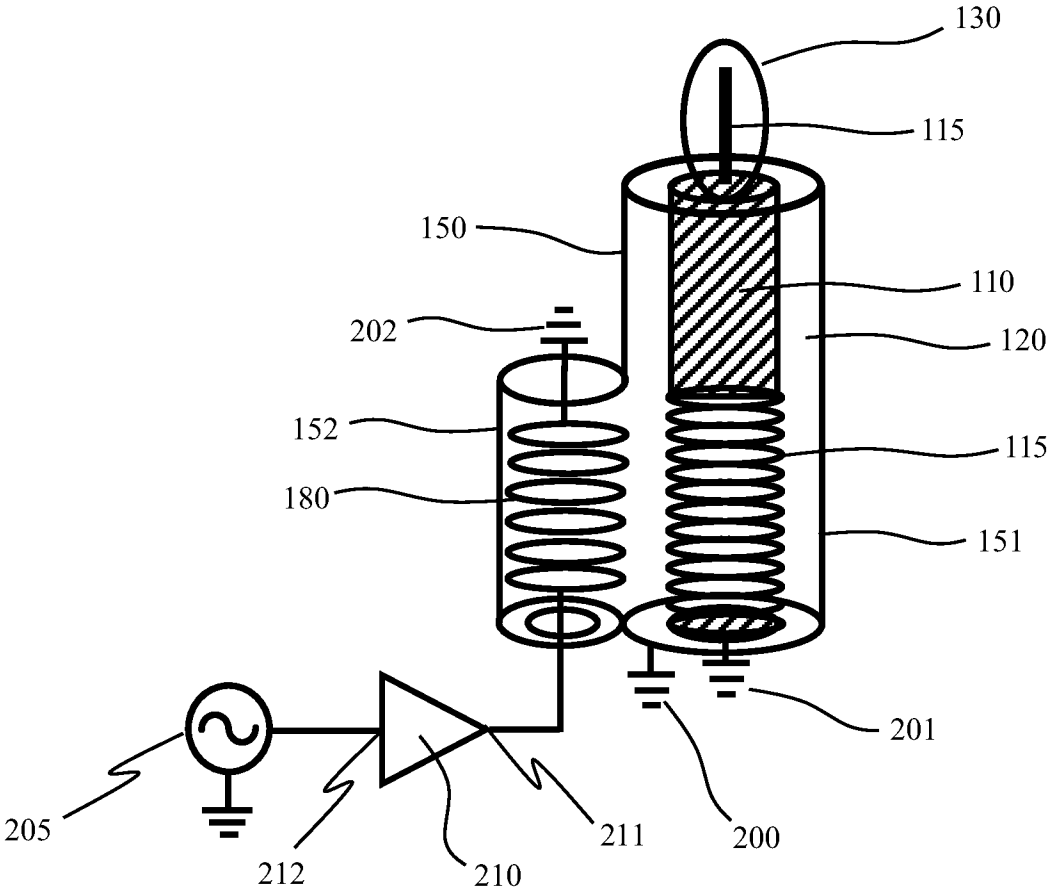
FIG. 9 illustrates another embodiment of the present invention. It is similar to FIG. 8 with RF input coupling and part of the center conductor of the coaxial resonator/waveguide in the form of spiral inductors but the input coupling element does not wrap around the center conductor.

FIG. 9 illustrates an electrodeless lamp according to another embodiment of the present invention. This diagram is merely an example, which should not unduly limit the scope of the claims. One of ordinary skill in the art would recognize many variations, alternatives, and modifications. The configuration of the electrodeless lamp in FIG. 9 is similar to the lamp illustrated in FIG. 8. One of the differences is that the input coupling element 180 that is in the form of a spiral inductor does not wrap around the center conductor 110 or 115. Instead, the input coupling element 180 is positioned inside the shield 150/152 of the coaxial resonator/waveguide. One end of the input coupling element 180 is connected to the output 211 of the RF amplifier 210. The other end of the input coupling element is connected to ground 202 or the shield 150/152 of the coaxial resonator/waveguide.

Similar to FIG. 8, the center conductor 110 illustrated in FIG. 9 of the coaxial resonator/waveguide comprises two portions: a spiral inductor 115 portion and a solid cylindrical portion 110. By increasing the inductance of the center conductor of the coaxial resonator/waveguide the resonant frequency of the resonator/waveguide can be decreased. One end of the spiral inductor 115 is connected to center conductor 110 while the other end is connected to ground 201 or shield 151 of the coaxial type resonator/waveguide which is also connected to ground potential 200. The other end of the center conductor 110 is coupled to the gas filled vessel 130.

Figure 10:
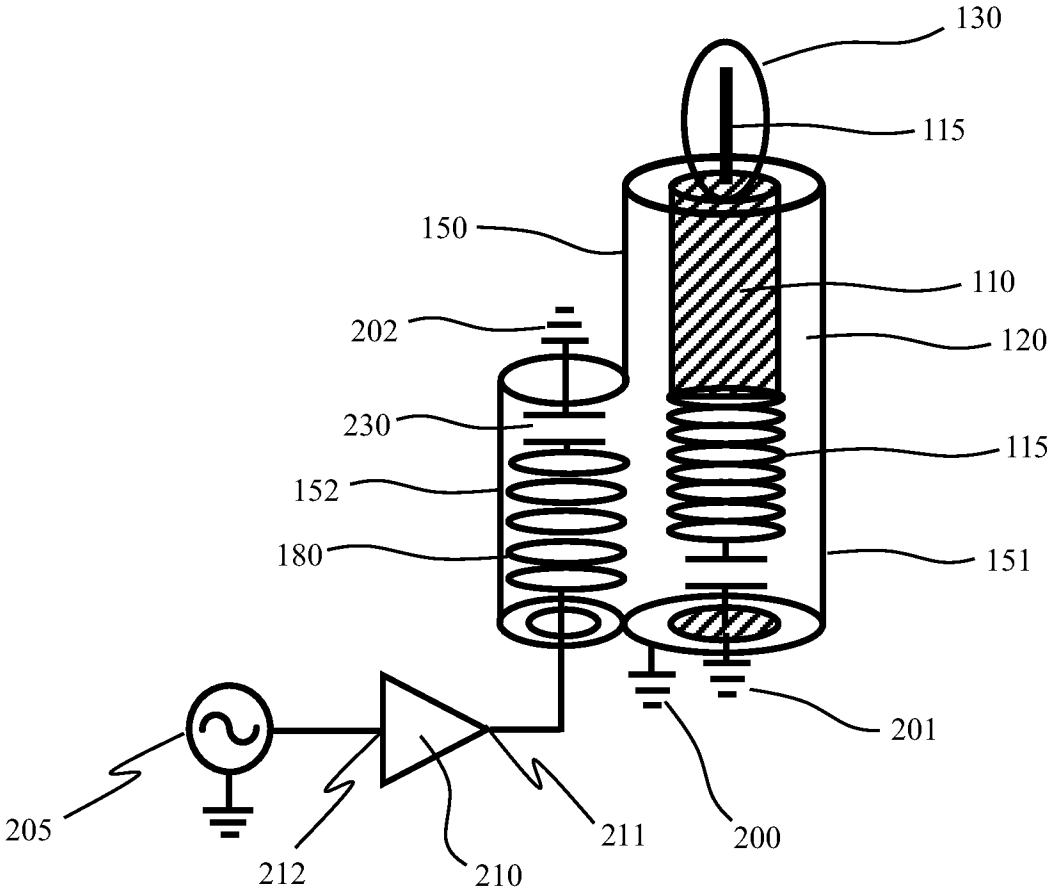
FIG. 10 is similar to FIG. 9 with the exception that the spiral inductors are connected to ground/shield through capacitors. The values of the capacitors are selected such that they provide a low impedance path to ground/shield at the resonant frequency of the coaxial type resonator/waveguide.

FIG. 10 illustrates an electrodeless lamp according to another embodiment of the present invention. This diagram is merely an example, which should not unduly limit the scope of the claims. One of ordinary skill in the art would recognize many variations, alternatives, and modifications. The configuration of the electrodeless lamp in FIG. 10 is similar to the lamp illustrated in FIG. 9. One of the differences is that the center conductor, which includes a solid portion 110 and an inductor portion 115, of the coaxial resonator/waveguide is electrically connected to the ground 201 or shield 151 through capacitor 240. The input coupling element 180 as shown is in the form of a spiral inductor. The input coupling element 180 is connected to the ground 202 and/or shield 152 through capacitor 230. In various embodiments, the values of the capacitors are selected such that they provide a low impedance path to ground/shield at the resonant frequency of the coaxial resonator/waveguide.

Figure 11A:
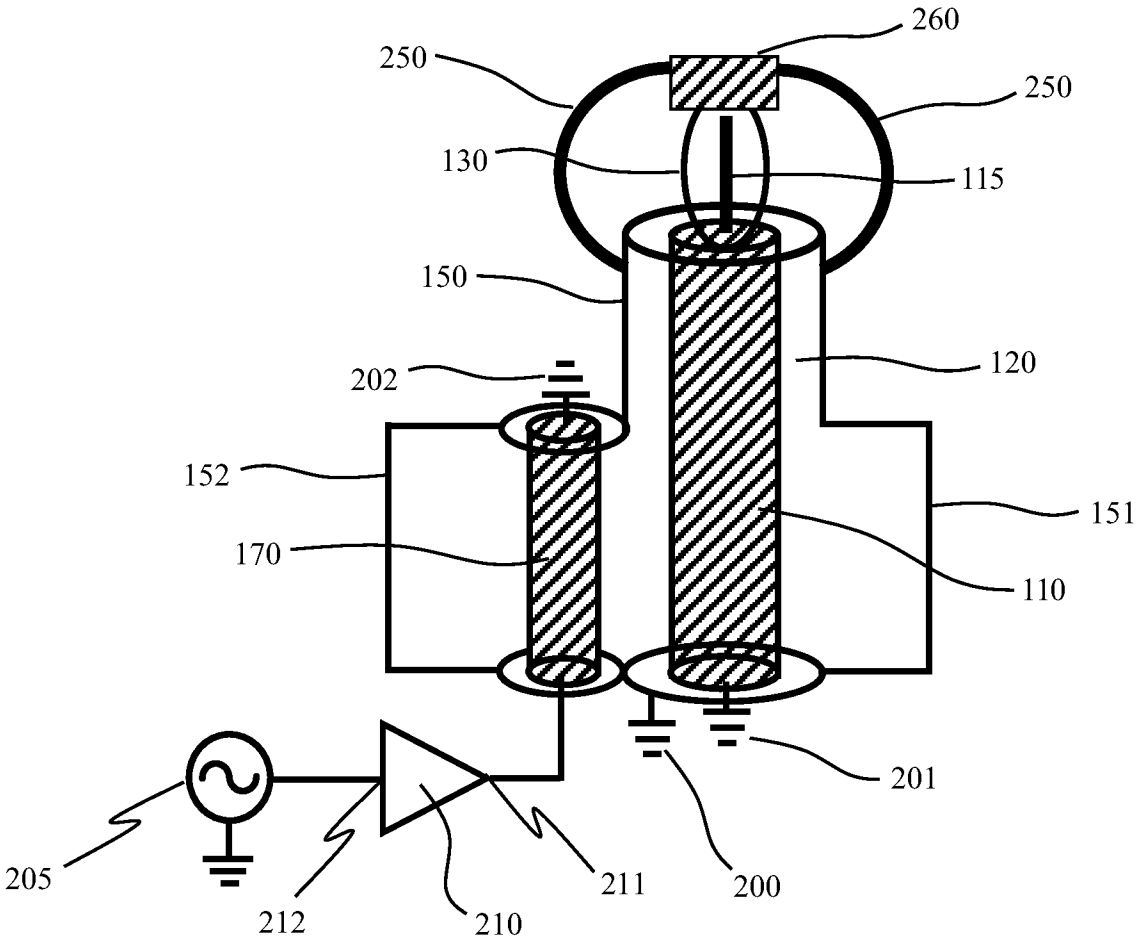
FIG. 11A illustrates another embodiment of the present invention. It is similar to FIG. 5A with the exception that the top of the gas filled vessel (bulb) is electrically coupled to ground.

FIG. 11A illustrates an electrodeless lamp having a top coupling element according to an embodiment of the present invention. This diagram is merely an example, which should not unduly limit the scope of the claims. One of ordinary skill in the art would recognize many variations, alternatives, and modifications. The electrodeless lamp in FIG. 11A is similar the electrodeless lamp illustrated in FIG. 5A. One of the differences it that the top of the gas filled vessel (bulb) 130 is electrically coupled to ground or shielding of the coaxial resonator/waveguide 150 using a top coupling element 260 and grounding straps 250. According to one embodiment, the top coupling element 260 is in direct contact with the bulb, and top coupling element consists essential of a refractory metal. In another embodiment, the top coupling element 260 comprises a thin layer of dielectric material (such as alumina) that can be used as the interface between the top coupling element and the bulb. Depending on the application, the top coupling element 260 can also be made using a dielectric material and coated with an electrically conductive layer.

Figure 11B:
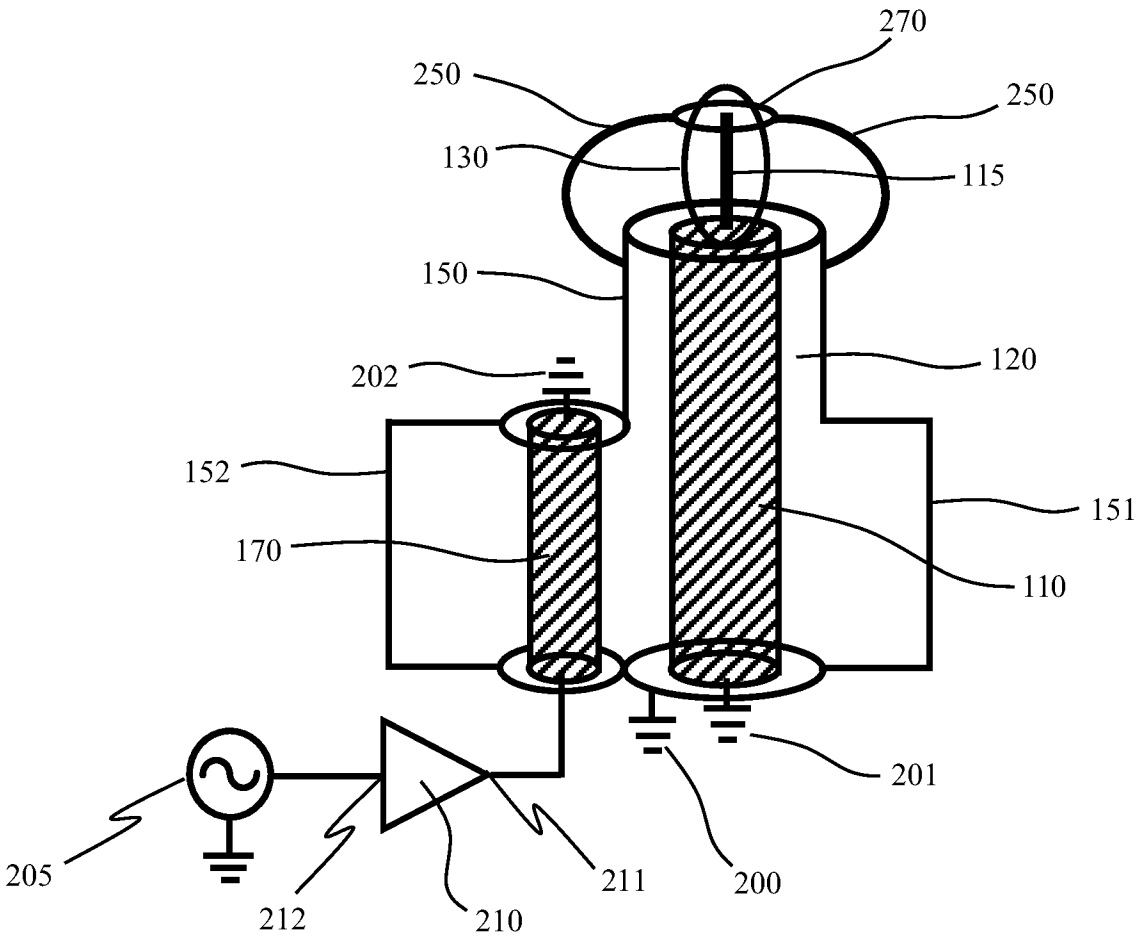
FIG. 11B illustrates another embodiment of the present invention. It is similar to FIG. 11A with the exception that the top of the gas filled vessel (bulb) is electrically coupled to ground using a conductive ring that is in close proximity to the bulb.

FIG. 11B illustrates an electrodeless lamp having a coupling ring according to an embodiment of the present invention. This diagram is merely an example, which should not unduly limit the scope of the claims. One of ordinary skill in the art would recognize many variations, alternatives, and modifications. As an example, the electrodeless lamp shown in FIG. 11B, is similar to the electrodeless lamp illustrated FIG. 11A with the exception that the top of the gas filled vessel (bulb) 130 is electrically coupled to ground or shielding of the coaxial resonator/waveguide 150 using a conductive ring 270. The conductive ring is in close proximity to the bulb and grounding straps 250.

While the above is a full description of the specific embodiments, various modifications, alternative constructions and equivalents may be used. Therefore, the above description and illustrations should not be taken as limiting the scope of the present invention which is defined by the appended claims.

What is claimed is:

1. A plasma lamp apparatus having a co-axial configuration, the apparatus comprising:

a radio frequency coupling element having a first portion and a second portion, a length is defined between the first portion and the second portion;

a bulb comprising a fill material coupled to the first portion;

a radio frequency source coupled to the second portion of the radio frequency coupling element;

a housing structure configured from the first portion to the second portion to enclose the length of the radio frequency coupling element; and a reference potential coupled to the housing structure.

2. The lamp of claim 1 wherein the first portion comprises a center conductor, and the second portion comprises an input coupling element.

3. The lamp apparatus of claim 1 wherein the first portion is electrically conductive.

4. The lamp apparatus of claim 1 wherein the first portion is substantially cylindrical in shape, the first portion comprising a hollow portion.

5. The lamp apparatus of claim 1 wherein the first portion and the second portion of the radio frequency coupling element are characterized by a cylindrical shape, the first portion and the second portion having different diameters.

6. The lamp apparatus of claim 1 wherein the housing structure comprises a resonator, the resonator associated with a resonant frequency associated with dimensions of the resonator.

7. The lamp apparatus of claim 1 wherein the radio frequency source comprises a coil structure within the housing structure.

8. The lamp apparatus of claim 1 wherein the radio frequency source is electrically coupled to an AC power source.

9. The lamp apparatus of claim 1 wherein:

the radio frequency coupling element comprises an axis running between the first and second ends;

the radio frequency source shares the axis with the radio frequency coupling element.

10. The lamp apparatus of claim 1 wherein the bulb material comprises a transparent or translucent body configured by an inner region and an outer surface region, a cavity being defined within the inner region.

11. The lamp apparatus of claim 1 wherein the first portion comprises a first end, the first end being coupled to the bulb, the first end being having a high voltage potential during in an operational mode.

12. The lamp apparatus of claim 1 wherein the send portion of the coupling element comprises a second end, the second end is grounded.

13. The lamp apparatus of claim 1 wherein the housing structure comprises a waveguide.

14. The lamp apparatus of claim 1 wherein the housing structure shields electromagnetic waves.

15. The lamp apparatus of claim 1 wherein the housing member comprises an air region.

16. The lamp apparatus of claim 1 wherein the housing structure comprises metal material.

17. The lamp apparatus of claim 1 wherein the housing structure is electrically conductive.

18. The lamp apparatus of claim 1 wherein the reference potential is grounded.

19. The lamp apparatus of claim 1 wherein the radio frequency waveguide structure comprises one or more materials.

20. The lamp apparatus of claim 1 wherein the radio frequency waveguide structure comprises one or more shapes.

21. The lamp apparatus of claim 1 wherein the housing structure is characterized by a substantially constant diameter from the first portion to the second portion.

22. The lamp apparatus of claim 1 wherein the housing structure is characterized by a first diameter within a vicinity of the first portion and a second diameter within a vicinity of the second portion.

23. The lamp apparatus of claim 1 wherein the radio frequency waveguide structure configured with the housing is flexible.

24. The lamp apparatus of claim 1 wherein the radio frequency waveguide structure configured with the housing is substantially rigid.

25. A plasma lamp apparatus having a coaxial configuration, the apparatus comprising:

a radio frequency coupling element having a first portion and a second portion, a length is defined between the first portion and the second portion, the radio frequency coupling element being substantially cylindrical in shape;

a bulb comprising a fill material coupled to the first portion;

an radio frequency source coupled to the second portion of the radio frequency waveguide structure;

a housing structure configured from the first portion to the second portion to enclose the length of the radio frequency coupling element; and a reference potential coupled to the housing structure.

26. A plasma lamp apparatus comprising:

a vessel being filled with a filling material, the vessel being free from electrode;

a center conductive member having a first end and a second end, the center conductive member being characterized by a substantially cylindrical shape centered on a first axis, the first end being coupled to the vessel;

an outer conductive member, the outer conductive member being characterized by a substantially cylindrical shape centered on the first axis, the outer conductive member having an inner volume, the center conductive member being positioned inside the inner volume, the outer conductive member being associated with one or more resonance frequencies;

a first ground potential, the first ground potential being electrically coupled to the second end of the center conductive member.

27. The apparatus of claim 26 wherein the filling material comprises lighting emitting material.

28. The apparatus of claim 26 wherein the filling material comprises gaseous species.

29. The apparatus of claim 26 wherein the filling material comprises one or more salts, the one or more salts being associated with at least a color.

30. The apparatus of claim 26 wherein the filling material comprises metal halide material.

31. The apparatus of claim 26 wherein the outer conductive member comprises a shield.

32. The apparatus of claim 26 further comprising a second ground potential electrically coupled to the outer conductive member.

33. The apparatus of claim 26 wherein the center conductive member is associated with a resonance frequency.

34. The apparatus of claim 26 wherein the center conductive member and the outer conductive member are insulated from each other by an insulating material.

35. The apparatus of claim 26 wherein the center conductive member and the outer conductive member are insulated from each other by air.

36. The apparatus of claim 26 further comprising an input coupling element.

37. The apparatus of claim 26 further comprising an RF source.

38. The apparatus of claim 26 further comprising an amplifier.

39. The apparatus of claim 26 further comprising an oscillator.

40. A plasma lamp apparatus comprising:

a vessel being filled with a filling material, the vessel being free from electrode;

a center conductive member having a first end and a second end, the center conductive member being characterized by a substantially cylindrical shape centered on a first axis, the first end being coupled to the vessel;

an outer conductive member, the outer conductive member being characterized by a substantially cylindrical shape centered on the first axis, the outer conductive member having an inner volume, the center conductive member being positioned inside the inner volume, the outer conductive member being associated with one or more resonance frequencies;

an input coupling module, the input coupling module comprising a housing and an input coupling element, the housing and the input coupling element being characterized by a substantially cylindrical shape, the input coupling element and the housing sharing a second axis.

41. The apparatus of claim 40 wherein the input coupling element comprises a third end and a fourth end, the third end being electrically coupled to an RF source, the fourth end being grounded.

42. The apparatus of claim 40 wherein the input coupling element comprises a third end electrically coupled to an RF source.

43. The apparatus of claim 40 further comprising an RF source electrically coupled to the input coupling module.

44. The apparatus of claim 40 further comprising an oscillator electrically coupled to the input coupling module.

45. The apparatus of claim 40 wherein the vessel comprises Argon or Xenon.

46. The apparatus of claim 40 wherein the vessel comprises Mercury, Sodium, Dysprosium, or Sulfur.

47. The apparatus of claim 40 wherein the vessel comprises a metal halide salt.

48. The apparatus of claim 40 wherein the vessel comprises Indium Bromide, Scandium Bromide, Thallium Iodide, Holmium Bromide, or Cesium Iodide.

49. The apparatus of claim 40 wherein the housing and the input coupling element are separated by air.

50. The apparatus of claim 40 wherein the housing and the input coupling element are separated by an insulating material.

51. The apparatus of claim 40 wherein the housing and the input coupling element are separated by a dielectric material.

52. The apparatus of claim 40 wherein the output conductive member and the input coupling element are capacitively coupled and/or inductively coupled.

53. The apparatus of claim 40 wherein the input coupling is characterized by a length of about 20 mm to 200 mm.

54. A plasma lamp apparatus comprising:

a vessel being filled with a filling material, the vessel being free from electrode;

a center conductive member having a first end and a second end, the center conductive member being characterized by a substantially cylindrical shape centered on a first axis, the first end being coupled to the vessel;

an outer conductive member having a first portion and a second portion, the first portion being characterized by a substantially cylindrical shape centered on the first axis and a first diameter, the second portion being characterized by the cylindrical shape centered on the first axis and a second diameter, the second diameter being greater than the first diameter, the outer conductive member having an inner volume positioned within the first and second portions of the outer conductive member, the center conductive member being positioned inside the inner volume; and a first ground potential, the first ground potential being electrically coupled to the second end of the center conductive member.

55. The apparatus of claim 54 further comprising an input coupling module, the input coupling module comprising a substantially cylindrical housing characterized by a third diameter.

56. The apparatus of claim 54 further comprising an input coupling module, the input coupling module comprising a substantially rectangular shape.

57. The apparatus of claim 54 further comprising an input coupling element, the input coupling element being grounded.

58. A plasma lamp apparatus comprising:

a vessel being filled with a filling material, the vessel being free from electrode;

a center conductive member having a first end and a second end, the center conductive member being characterized by a substantially cylindrical shape centered on a first axis, the first end being coupled to the vessel;

an outer conductive member having a first portion and a second portion, the first portion being characterized by a substantially cylindrical shape centered on the first axis and a first diameter, the second portion being characterized by a substantially rectangular shape, the outer conductive member having an inner volume positioned within the first and second portions of the outer conductive member, the center conductive member being positioned inside the inner volume; and a first ground potential, the first ground potential being electrically coupled to the second end of the center conductive member.

59. The apparatus of claim 58 further comprising an input coupling module, the input coupling module comprising a substantially cylindrical shape.

60. A plasma lamp apparatus comprising:

a vessel being filled with a filling material, the vessel being free from electrode;

a center conductive member having a first end and a second end, the center conductive member being characterized by a substantially cylindrical shape centered on a first axis, the first end being coupled to the vessel;

an outer conductive member having a first portion and a second portion, the first portion being characterized by a substantially cylindrical shape centered on the first axis and a first diameter, the second portion being characterized by a substantially semi-spherical shape, the outer conductive member having an inner volume positioned within the first and second portions of the outer conductive member, the center conductive member being positioned inside the inner volume; and a first ground potential, the first ground potential being electrically coupled to the second end of the center conductive member.

61. The apparatus of claim 60 further comprising an input coupling module, the input coupling module comprising a substantially semi-spherical shape.

62. A plasma lamp apparatus comprising:

a vessel being filled with a filling material, the vessel being free from electrode;

a center conductive member having a first end and a second end, the center conductive member being characterized by a substantially cylindrical shape centered on a first axis, the first end being coupled to the vessel;

an outer conductive member, the outer conductive member being characterized by a substantially cylindrical shape centered on the first axis and a first diameter, the outer conductive member having an inner volume positioned within the outer conductive member, the inner volume having a first portion and a second portion, the inner volume being substantially cylindrical, the center conductive member being positioned inside the first portion of the inner volume;

a first capacitor being positioned with in the second portion of the inner volume, the first capacitor being electrically coupled to the second end of the center conductive member; and a first ground potential, the first ground potential being electrically coupled to the first capacitor.

63. The apparatus of claim 62 further comprising:

an input coupling module, the input coupling module having a cylindrical housing and an input coupling element, the cylindrical housing having a second axis, the input coupling element being characterized by substantially centered around the second axis.

64. The apparatus of claim 62 further comprising:

an input coupling module, the input coupling module having a housing in a substantially spherical shape and an input coupling element in a substantially cylindrical shape.

65. The apparatus of claim 62 further comprising an input coupling module, the input coupling module comprises:

a cylindrical housing member;

an input coupling element, the input coupling element sharing a second axis with the cylindrical housing member; and a second capacitor positioned within the cylindrical housing member and electrically coupled to the input coupling element.

66. The apparatus of claim 62 wherein the first capacitor is adapted to provide a low impedance path between the center conductive member and the ground potential.

67. A plasma lamp apparatus comprising:

a vessel being filled with a filling material, the vessel being free from electrode;

a center conductive member having a first end and a second end, the center conductive member being characterized by a substantially cylindrical shape centered on a first axis, the first end being coupled to the vessel;

an outer conductive member, the outer conductive member being characterized by a substantially cylindrical shape centered on the first axis and a first diameter, the outer conductive member having an inner volume positioned within the outer conductive member, the inner volume having a first portion and a second portion, the inner volume being substantially cylindrical, the center conductive member being positioned inside the first portion of the inner volume;

an input coupling element including a spiral inductor positioned between the center conductive member and the outer conductive member, the spiral inductor being wrapped around a portion of the center conductive member; and a first ground potential, the first ground potential being electrically coupled to the second end of the center conductive end.

68. The apparatus of claim 67 wherein the input coupling element is coupled to an RF source.

69. The apparatus of claim 67 wherein further comprising an oscillator.

70. The apparatus of claim 67 wherein the spiral inductor is centered on the first axis.

71. The apparatus of claim 67 wherein the outer conductive member is grounded.

72. The apparatus of claim 67 further comprising an amplifier.

73. A plasma lamp apparatus comprising:

a vessel being filled with a filling material, the vessel being free from electrode;

a center conductive member having a first end and a second end, the center conductive member being characterized by a substantially cylindrical shape centered on a first axis, the first end being coupled to the vessel, the center conductive member being characterized by a first length;

an outer conductive member, the outer conductive member being characterized by a substantially cylindrical shape centered on the first axis and a first diameter, the outer conductive member having an inner volume positioned within the outer conductive member, the inner volume having a first portion and a second portion, the inner volume being substantially cylindrical, the inner volume including first portion and a second portion, the center conductive member being positioned inside the first portion of the inner volume;

an input coupling element including a spiral inductor positioned within the second portion of the inner volume, the spiral inductor having a inner portion, the inner portion being free from a solid portion of the center conductive member; and a first ground potential, the first ground potential being electrically coupled to the second end of the center conductive end.

74. The apparatus of claim 73 wherein the spiral inductor is grounded.

75. The apparatus of claim 73 further comprising an amplifier.

76. The apparatus of claim 73 further comprising an RF source.

77. The apparatus of claim 73 further comprising a waveguide for the input coupling element.

78. The apparatus of claim 73 wherein the center conductive member comprises the solid portion and an inductor portion, the solid portion being positioned inside the first portion of the inner volume, the inductor portion being positioned inside the spiral inductor.

79. A plasma lamp apparatus comprising:

a vessel being filled with a filling material, the vessel being free from electrode;

a center coupling member having a first end and a second end, the center coupling member being characterized by a substantially cylindrical shape centered on a first axis, the first end being substantially solid and coupled to the vessel, the second end comprising a first spiral conductor;

an outer conductive member, the outer conductive member being characterized by a substantially cylindrical shape centered on the first axis and a first diameter, the outer conductive member having an inner volume positioned within the outer conductive member, the inner volume having a first portion and a second portion, the inner volume being substantially cylindrical, the center coupling member being positioned inside the of the inner volume;

an input coupling member, the input coupling member including an housing a second spiral inductor positioned within the housing; and a first ground potential, the first ground potential being electrically coupled to the second end of the center coupling member.

80. A plasma lamp apparatus comprising:

a vessel being filled with a filling material, the vessel being free from electrode;

an center coupling member having a first end and a second end, the center coupling member being characterized by a substantially cylindrical shape centered on a first axis, the first end being substantially solid and coupled to the vessel, the second end comprising a first spiral conductor;

an outer conductive member, the outer conductive member being characterized by a substantially cylindrical shape centered on the first axis and a first diameter, the outer conductive member having an inner volume positioned within the outer conductive member, the inner volume having a first portion and a second portion, the inner volume being substantially cylindrical, the center coupling member being positioned inside the of the inner volume;

an input coupling member, the input coupling member including and a housing and a second spiral inductor positioned within the housing;

a first capacitor positioned inside the inner volume and electrically coupled to the first spiral conductor; and a first ground potential, the first ground potential being electrically coupled to the first capacitor.

81. The apparatus of claim 80 further comprising a second capacitor positioned within the housing and electrically coupled to the second spiral conductor.

82. The apparatus of claim 80 further comprising an RF source.

83. The apparatus of claim 80 further comprising an oscillator.

84. The apparatus of claim 80 further comprising insulating material between the center coupling member and the outer conductive member.

85. A plasma lamp apparatus comprising:

a vessel being filled with a filling material, the vessel being free from electrode, the vessel having a top side and a bottom side;

a first output coupling member having a first end and a second end, the first output coupling member being characterized by a substantially cylindrical shape centered on a first axis, the first end being substantially solid and coupled to the bottom side of the vessel;

a second coupling member coupled to the top side of the vessel;

an outer conductive member, the outer conductive member being characterized by a substantially cylindrical shape centered on the first axis and a first diameter, the outer conductive member having an inner volume positioned within the outer conductive member, the inner volume having a first portion and a second portion, the inner volume being substantially cylindrical, the first output coupling member being positioned inside the of the inner volume;

an input coupling member, the input coupling member including a housing and an input coupling element;

a first ground potential, the first ground potential being electrically coupled to the second end of the first output coupling member.

86. The apparatus of claim 85 further comprising a grounding strap, the grounding strip being coupled to the outer conductive member and the second coupling member.

87. The apparatus of claim 85 where the second coupling member comprises a reflective surface.

88. The apparatus of claim 85 wherein the second coupling member is in direct contact with the vessel.

89. The apparatus of claim 85 wherein the second coupling member comprises refractory metal material.

90. The apparatus of claim 85 wherein the second coupling member comprises a layer of dielectric material.

91. The apparatus of claim 85 wherein the second coupling member comprises an electrically conductive coating.

92. A plasma lamp apparatus comprising:

a vessel being filled with a filling material, the vessel being free from electrode;

a center conductive member having a first end and a second end, the center conductive member being characterized by a substantially cylindrical shape centered on a first axis, the first end being coupled to the vessel;

an outer conductive member, the outer conductive member being characterized by a substantially cylindrical shape centered on the first axis, the outer conductive member having an inner volume, the center conductive member being positioned inside the inner volume, the outer conductive member being associated with one or more resonance frequencies;

a conductive ring electrically coupled to the vessel;

a grounding strap electrically coupled to the conductive ring and the outer conductive member; and a first ground potential, the first ground potential being electrically coupled to the second end of the center conductive member.

93. The apparatus of claim 92 wherein the center conductive member is insulated from the outer conductive member.

94. The apparatus of claim 92 further comprising an input coupling member.

95. The apparatus of claim 92 further comprising an RF source.

96. The apparatus of claim 92 further comprising an amplifier.

97. The apparatus of claim 92 further comprising an input conductive member.

98. The apparatus of claim 92 wherein the grounding strap comprises metal wires.

99. A plasma lamp apparatus comprising:

a vessel being filled with a filling material, the vessel being free from electrode, the vessel having a top side and a bottom side;

a center conductive member having a first end and a second end, the center conductive member being characterized by a substantially cylindrical shape centered on a first axis, the first end being coupled to the vessel;

a top coupling member coupled to the top side of the vessel; and an outer conductive member, the outer conductive member being characterized by a substantially cylindrical shape centered on the first axis, the outer conductive member having an inner volume, the center conductive member being positioned inside the inner volume, the outer conductive member being associated with one or more resonance frequencies;

a first ground potential, the first ground potential being electrically coupled to the second end of the center conductive member.

100. The apparatus of claim 99 further comprising a grounding strap, the grounding strip being coupled to the outer conductive member and the top coupling member.

101. The apparatus of claim 99 wherein the second coupling member is in direct contact with the vessel.

102. The apparatus of claim 99 wherein the top coupling member comprises refractory metal material.

103. The apparatus of claim 99 wherein the top coupling member comprises a layer of dielectric material.

104. The apparatus of claim 99 wherein the top coupling member comprises an electrically conductive coating.

* * * * *